United States Patent [19]

Pattillo et al.

[11] 4,023,736

[45] May 17, 1977

[54] CHOPPER PLATE

[75] Inventors: William C. Pattillo, Stone Mountain; Robert N. Lukat, Morrow, both of Ga.; Neils N. Engel, Sante Fe, N. Mex.

[73] Assignee: Southern Saw Service, Inc., Atlanta, Ga.

[22] Filed: Apr. 29, 1976

[21] Appl. No.: 681,760

[52] U.S. Cl. ..... 241/82.5

[51] Int. Cl.[2] ..... B02C 18/36

[58] Field of Search ..... 241/82.1, 82.2, 82.3, 241/82.4, 82.5, 82.6, 82.7; 425/308, 310, 311, 313

[56] References Cited

UNITED STATES PATENTS

| | | | |
|---|---|---|---|
| 271,399 | 1/1883 | Baker | 241/82.6 |
| 1,429,348 | 9/1922 | Human | 241/82.5 |
| 1,768,365 | 6/1930 | MacFarlane | 425/311 |
| 2,284,722 | 6/1942 | Burns | 241/82.4 |
| 2,865,417 | 12/1958 | Waters | 241/82.5 |
| 3,730,444 | 5/1973 | Pattillo | 241/82.5 |
| 3,934,827 | 1/1976 | Seydelmann | 241/82.3 |

*Primary Examiner*—Granville Y. Custer, Jr.
*Attorney, Agent, or Firm*—Newton, Hopkins & Ormsby

[57] ABSTRACT

A chopper plate which cooperates with a rotating blade of a meat grinder for the purpose of grinding meat. The plate has a plurality of holes arranged in groups circumferentially spaced around the central hole so as to leave a plurality of radially extending spokes between the groups of holes.

11 Claims, 5 Drawing Figures

CHOPPER PLATE

BACKGROUND OF THE INVENTION

This invention relates to a chopper plate and is more particularly concerned with a chopper plate which is operative in conjunction with a meat grinder so as to cooperate with the rotating blade thereof for chopping and grinding meat.

DESCRIPTION OF THE PRIOR ART

In the past, chopper plates have been extensively used in meat grinders so as to produce ground meats of various types. In recent years, the horsepower of a grinder has been progressively increased, for example from about 1½ hp. to about 10 hp. As a rule only one plate and one chopper knife is used; however, more recently knives in tandem have been used, each having its chopper plate. Such tandem or "piggy back" grinding exerts extreme pressure on the plates. Usually these prior art chopper plates are provided with equally spaced holes, disposed in parallel lines, the number of holes progressively increasing and then progressively decreasing across the face of the plate. These prior art chopper plates are subject to breakage since tremendous pressures are exerted on them by the knife and by the meat as the meat is urged through these small holes, while being chopped by the blade of the chopper. Sinews or tendons of the meat are sometimes not cut by the knives and are caused to loop over a portion of the plate so that the ends of a length of sinew project through two of the holes, simultaneously, thereby providing a camming surface for causing the blade to ride over the sinew or tendon. With such high loading of the chopper plates, the plates, which incidentally are of high hardness, may break along various patterns. Thus, the prior art chopper plates have been relatively thick, being approximately ½ inch in thickness.

It is not desirable to hve a thick chopper plate since the meat, in passing through the small holes of the plate, is heated, thereby providing a lower grade of ground meat.

Thus, there has been a need for some time for a chopper plate which will withstand such increased pressures.

The chopper plate of the present invention is of substantially increased strength and therefore enables the plate to be made thinner and yet retain the same strength. Also, the cutting action of the blades or knives operating with my plate is improved by the configuration of the holes in the plate of the present invention.

SUMMARY OF THE INVENTION

Briefly described, the present invention comprises an integral or unitary chopper plate in which the holes, through the plate, are arranged in groups or areas spaced from each other to provide evenly spaced, unperforated spokes or ribs extending from the central hub to the peripheral rim of the plate.

DESCRIPTION OF THE PREFERRED EMBODIMENT

Figure 1:
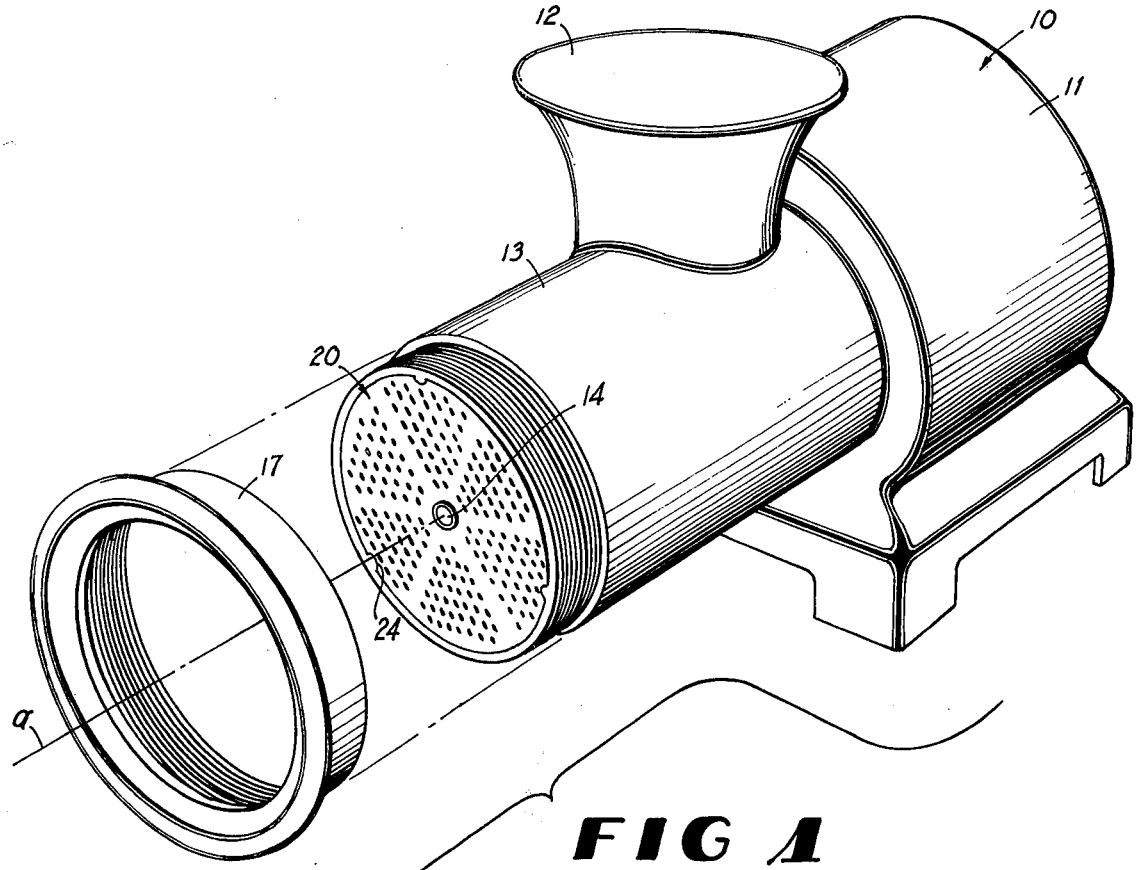
FIG. 1 is a perspective view of a conventional meat grinder having the chopper plate of the present invention attached thereto.
Figure 2:
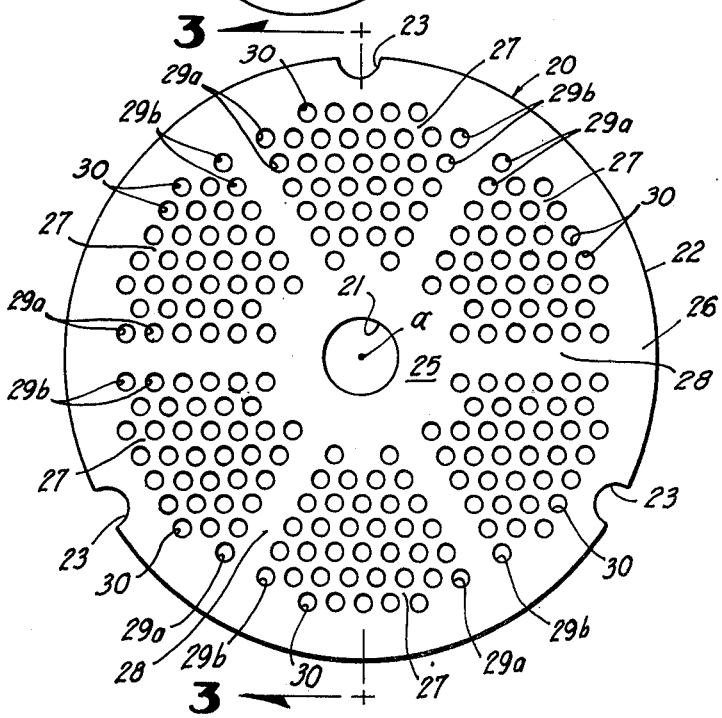
FIG. 2 is a plan view of the chopper plate of the grinder shown in FIG. 1.
Figure 3:
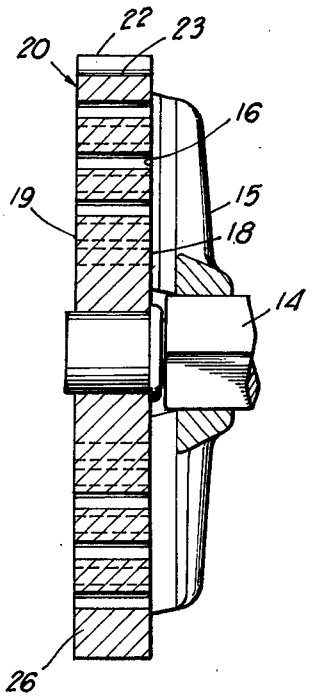
FIG. 3 is a vertical sectional view taken substantially along line 3—3 and showing a chopper blade engaging the surface of the chopper plate.

Referring now in detail to the embodiments chosen for the purpose of illustrating the present invention, numeral 10 in FIGS. 1, 2 and 3 denotes generally a conventional meat chopper or grinder having an intake port of spout 12 communicating with a barrel 13 of the meat chopper 10. The barrel 13 contains the usual central shaft 14 which is provided with an auger (not shown) for the delivery of the meat from spout 12 along the barrel 13 in an axial direction progressively to a chopper blade or knife 15 having radially extending cutting edges, such as edge 16, mounted adjacent the exit end of the grinder 10.

Outwardly of the chopper blade 15, a chopper plate, denoted generally by numeral 20, is positioned to cooperate with the cutting edges 16 of the chopper blade 15, in the usual way. A retaining ring 17 threaded onto the end of barrel 13 removably retains the chopper plate 20 in place.

As best seen in FIGS. 2 and 3, the chopper plate 20 has an integral or unitary, circular, disc shaped body formed of a flat metal plate which has a central opening 21 and an outer periphery 22, both concentric about a central axis $\alpha$. The chopper plate 20 is provided with spaced recesses or peripheral notches 23 which receive the ridges 24 on the barrel 13 so as to prevent rotation of the plate 20. Outwardly of the central opening 21, there is a generally imperforate, annular hub area or hub 25, while inwardly of the periphery 22, there is an imperforate annular larger rim area or rim 26. The plate 20 has an inner, flat or planar, polished surface 18 and an outer, flat or planar, polished surface 19 parallel to surface 18.

According to the present invention, there are a plurality of perforated areas or zones 27 disposed between the hub 25 and the rim 26. Each of thse perforated areas 27 is identical, the areas being circumferentially equally spaced from each other to define, therebetween, a plurality of radial spokes 28 which extend from the hub 25 to the rim 26.

In more detail, each of the perforated areas 27 includes a plurality of side holes **29*a* and side holes 29*b* on opposite sides of the central holes 30.**

In each prescribed area or zone 27, there is a single straight row of the holes **29*a* and a single straight row or holes 29*b* which converge inwardly from rim 26 to terminate at hub 25. The inner or central holes 30 are symmetrically disposed in each area or zone 27, having their centers in alignment in rows parallel to the rows of holes 29*a*, parallel to the rows of holes 29*b*, and respectively also aligned with a hole 29*a* while being parallel to the row of holes 29*b* and vice versa. The centers of the holes 30, in a single row, extend in a straight line between the center of a hole 29*a* and the center of a hole 29*b* of equal distance from the axis $\alpha$. Thus, rows of holes 30 are provided between all pairs of holes which are on increasing length cords of the periphery 29*a*, 29*b*, except the innermost pair of holes 29*a*, 29*b* of a presecribed area 27. Furthermore, there is an outer cordial row of holes 30 outwardly of the row including the outermost pair of holes 29***a*, 29*b*.

The holes 29*a*, 29*b* and 30 are straight holes parallel to axis $\alpha$, each being approximately .136 inch in diameter but may have a diameter from about 0.09 inch to about 0.2 inch. These holes are equally spaced from center to center by approximately 0.185 inch. The spacing from center to center of holes 29*a*, 29*b*, 30 may vary from about 0.09 inch to about 0.2 inch. The spacing from center to center of the holes 29*a*, 29*b* and 30 leaves webs 27 between adjacent holes of about 0.049 inch in each area.

The holes 29*a*, 29*b* and 30 of parallel rows are respectively staggered with respect to the holes of adjacent rows.

The holes 29*a* are on one side of each spoke 28 and the holes 29*b* on the other side of that spoke 28 are disposed in parallel rows which are equally spaced on opposite sides of a radius through the spoke 28. Thus, the width of each spoke 28, from one edge of hole 29*a* to its adjacent hole 29*b*, is approximately 0.134 inch. This width of the spoke 28 is usually approximately equal to the sum of the diameter of one hole 29*a*, 29*b* or 30 plus two times the distance of the web 27. The width of the spoke 28 is preferably from about 1½ to about 2 times the diameter of a hole 29*a*, 29*b* or 30.

It is also to be noted that the width of each spoke 28 should substantially exceed the width of the cutting edge 16 of the knife 15 and the holes 29*a*, ie, the holes which the edge 16 passes over, after it has passed over the adjacent spoke 28, should be offset from the radius by an amount approximately equal to the offset of the cutting edge 16 from the radius. Thus, should the blade or knife 15 be deflected away from surface 18 by the meat, being urged through holes 29*a*, 29*b* and 30, the spoke 28 will provide an usually unobstructed area for reseating the edge 16 flat against the surface 18. This seating under a reduced cutting load will also tend to permit an acceleration of the speed of the blade rotation.

The general alignment of the holes 29*a* with the cutting edge 16, as the edge 16 passes over the holes 29*a*, due to the forward offset of the edge 16 in the direction of rotation will cause a simultaneous chop of the edge 16 along all holes 29*a* s as to sever the meat through a direct movement rather than a progressive or generally successive angular slicing which occurs when the knife passes over the other holes.

While I have illustrated a plate having six spokes 28 radiating from the hub 25 and connected to the rim 26, it will be understood by those skilled in the art that from three to about six equally, circumferentially spaced, spokes 28 may be incorporated into the plate 20 without departing from the scope of the present invention.

In a size 32 plate, such as that illustrated in the drawings, the holes 29*a*, 29*b* and 30 are each one-eighth inch in diameter. Two hundred and twenty-two holes 29*a*, 29*b* and 30 are provided in six equally spaced areas 27, having 37 holes 29 and 30, each. The holes configuration for holes 29*a*, 29*b* and 30 results in a hexagonally symmetrical hole pattern for the holes 29 and 30, with six spokes 28 having widths of one hole plus two webbed distances at 30° angles about the center hole 21 of the plate 20. It is recommended that the plates, if a size 32 plate is desired, should have a thickness from about 0.4 inches to about 0.5 inches and have a hardness range of from about 60 to 62 HRC.

When plates 20, such as that described above, are tested in a Riehle universal testing machine, using the same breaking jig and loading procedure as was utilized in testing conventional plates, it has been found that the average strength of a plate 20 constructed according to the present invention (222 holes) was such that the plate sustained a maximum load of 13,550 pounds, whereas a conventional plate having equally dispersed holes (270 holes) sustained a maximum load of only 9,750 pounds. This is a 3,700 pound improvement or an improvement of 37.9%.

Furthermore, the average strength increase of a plate 20 constructed in accordance with the present invention over a conventional plate having 270 holes and of the same volume and material was from 11,350 maximum load pounds to 13,450 maximum load pounds, an increase of 2,100 maximum load pounds or an 18.5 percent improvement. Thus, using the spoke construction of the present invention, the thickness of a plate may be reduced by approximately 22 percent and still have the same strength as a prior art plate. Such a reduction should improve the quality of the ground product.

While the number of holes in the pattern of the plate, namely the holes 29*a*, 29*b* and 30, has been reduced from 270 holes to 222 holes, thus decreasing the area available for the passage of meat by approximately 18 percent. This, however had a synergistic effect in that it appears that the cutting or chopping ability of a plate 20 constructed in accordance' with the present invention has been improved. Breakage of plates as a result of grinding either frozen meat or piggy-back grinding operations appears to have been reduced, and the cutting or chopping ability of the plate as well as its effective life has been increased.

The improved cutting ability may be explained in that the surface 28 is not deflected appreciably and also chopper blade 15 usually contains a cutting edge which is forward of a radius parallel to that cutting edge. In like manner, the holes 29*a* adjacent the spoke 28 are arranged in rows which are forward in the direction of rotation of the radius of the plate 20. Thus, as pointed out above, the cutting edge of the chopper knife is disposed approximately parallel to a row of holes 29*a* after the blade has passed over the spoke 28, thereby making a simultaneous cut along a row of the holes 29*a*. Thereafter, however, there is a progressive cut along a row of holes 29*b* and 30 before reaching the next adjacent spoke 28. The simultaneous cutting action across a row of holes 29*a* may cause the grasping of sinews which are draped across two or more of the holes 29*a* or 30 so as to insure a cutting action, as opposed to a pulling of the sinews along the path of travel of the blade 15 since the sinews would be arrested by the simultaneous chopping action along two or more of the holes 29*a*.

The sinews or muscle tissue have a tendency to drape through two or more holes and, therefore, provide a camming action for the blade to ride over these sinews in a conventional chopper plate arrangement. By providing the spokes 28, the spacings between holes 29*a* and 29*b* are increased and the spacings between holes 29 and 30 remain at their normal spacing. This enables the fibers and sinews and tough materials to be pulled for a long distance by the blade 15, thus urging them out of holes over which they may be draped and providing sufficient travel for the blade 15 to again firmly engage the cutting surface of the plate 20.

The interruption of holes in the imperforate area of spokes permits the intermittent reseating of the blade edge 16 before the cutting, over the perforate areas of holes 29*a*, 29*b*, 30 begins. This permits a raking of the knife edge 16 along the surface of the spokes 28 under reduced load conditions. Thus the edge 16 is firmly seated to begin its cutting over the perforate area 27.

Figure 4:
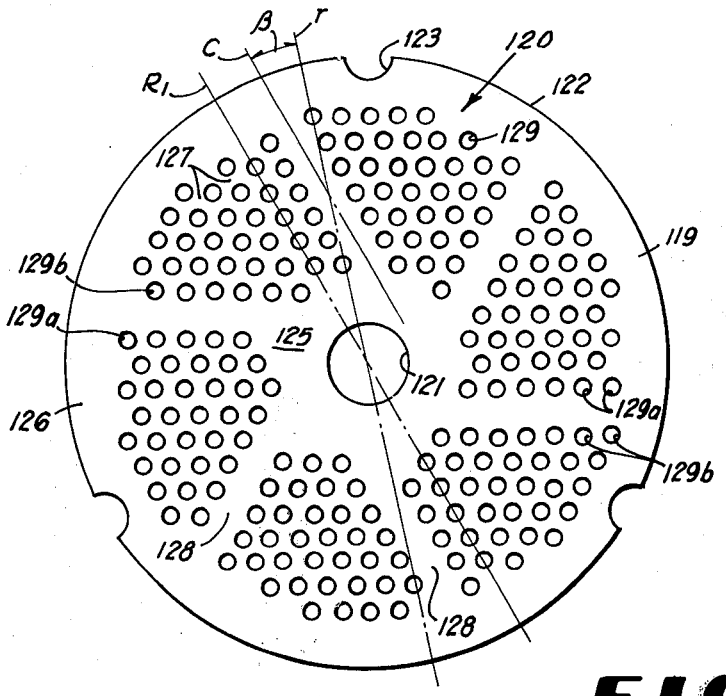
FIG. 4 is a plan view similar to FIG. 2 but showing a modified form of the chopper plate.
Figure 5:
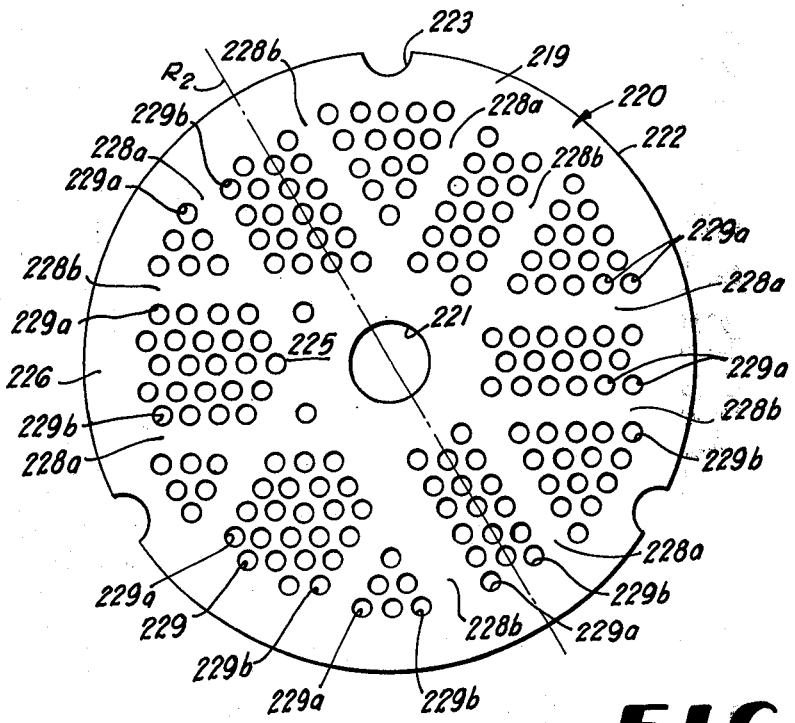
FIG. 5 is a plan view of still another modified form of the present invention.

Referring now to FIGS. 4 and 5, the second and third embodiments of the present invention include chopper plates 120 and 220 provided respectively with central openings 121 and 221, identical to opening 21 and through which the cylindrical end portion of shaft 14 is adapted to project when the plate 120 or 220 is installed on grinder 10. The peripheries 122 and 222 and the notches or recesses 123 and 223 are identical to periphery 22 and notches 23. The plates 120 and 220 have polished parallel inner and outer surfaces, such as surfaces 119 and 219, which are essentially identical to the surfaces 18 and 19. The plates 120 and 220 include hubs 125 and 225 surrounding holes 121 and 221, respectively, as well as rims 126 and 226 concentrically spaced outwardly of the hubs 121 and 221 and immediately inwardly of the rims 122 and 222.

The plate 120 is provided with equally spaced holes 129 extending axially through the plate 120, perpendicular to the surfaces such as surface 19. Holes 129 are aligned in horizontal, parallel rows along plate 120, the holes 129 of one row being staggered with respect to the holes 129 of the next adjacent row. Holes 129 are also arranged in circumferentially spaced, generally triangular groups which form perforated areas or zones 127 disposed between the hub 125 and the rim 126. Each perforated area 127 is similar in that their straight, inwardly converging borders or edges are defined by straight rows of side holes 129*a* and 129*b*.

Between each opposed parallel pair of rows of holes 129*a* and 129*b* of adjacent areas 127 is a straight unperforated area, forming a spoke 128 extending in generally a radial direction from rims 119 to hub 125. The centerline C of each spoke 128, however, is at an acute offset angle $\beta$ to the radius containing the spoke 128. Thus, each spoke 128 begins at rim 119, on one side of a radius line *r* and terminates at hub 125, on the other side thereof. Plate 120 in FIG. 4 has six circumferentially spaced spokes 128. Three to six spokes 128 are recommended.

By the arrangement of plate 120 the cutting edge 16 of knife 18, when rotating clockwise against surface 119, as viewed in FIG. 4, will progressively cut along the row of holes 129*b*, successively slicing across each hole 129*b*, beginning with the outmost hole 129*b* and moving inwardly to the innermost hole 129*b* in that row.

In the plate 220 depicted in FIG. 5, pairs of straight, spaced, parallel, unperforated or imperforate areas forming straight, spaced spokes 228*a* and 228*b* extend from one portion of the rim 226 to the hub 225, the spokes 228*a*, 228*b* of each pair being on opposite sides of the central hole 221. From three to five parallel rows of holes 229, 229*a*, 229*b* space the parallel spokes 129*a*, 129*b* apart. Since the spokes 228*a*, 228*b* are disposed generally tangentially to the central hole 221, a cutting edge, such as edge 16 of blade 15, would slice progressively over the holes 229*b*, from innermost hole to outermost, adjacent a spoke 228*a;* and then, progressivey, from outermost to innermost hole 229*b* adjacent a spoke 228*b*, when sweeping along surface 219 in a clockwise direction. This tends to work the meat inwardly and then outwardly.

Between the pairs of spokes 228*a*, 228*b*, generally triangular shaped perforated areas are provided containing holes 229, 229*a* and 229*b*, the holes 229*a*, 229*b* being the holes bordering the spokes 228*a*, 228*b*.

In the plate 120 of FIG. 4 and in the plate 220 of FIG. 5, the configurations of holes on the right sies of radius $R_1$ or $R_2$, as the case may be, are slightly different from the configurations on the left sides thereof. This depicts that the plate 120 can be asymmetrical, as illustrated, or symmetrical using either configuration of holes of plate 120 or plate 220.

The configuration depicted in the right half of plate 120 is about as strong as the configuration of plate 20, with 11.8 percent of the available holes blocked by spokes 128. The left hand configuration of plate 120 has 16.67 percent of the available holes blocked. The right hand configuration of plate 220 has 23.8 percent of the available holes blocked and the left hand configuration 28.5 percent blocked. The strength of plate 220 is more than double the strength of a conventional plate, with the right side stronger than the left.

I claim:

1. A chopper plate for meat grinder composed of a body having a planar surface for cooperating with the chopper knife of the meat grinder moved along said surface, said body having a plurality of perforate areas respectively provided with a plurality of spaced holes, and an imperforate area extending from the central portion of said body to the edge of said body between and separating said perforate areas, the distance between the adjacent holes of the respective perforate areas across said imperforate areas being greater than the distance between adjacent holes within said adjacent areas, and wherein said holes of each of said perforate areas are arranged in parallel rows on both sides of an adjacent imperforate area.

2. The chopper plate defined in claim 1 wherein said body is circular and is provided with a central opening and a peripheral rim portion, said imperforate area forming a spoke extending radially from said central opening to said rim.

3. The chopper plate defined in claim 2 wherein said rim portion has an imperforate peripheral rim, and an imperforate hub disposed concentrically with said rim about said central opening, said spoke being straight and extending from said rim to said hub.

4. The chopper plate defined in claim 3 wherein said imperforate area includes a plurality of additional spokes extending radially from said hub to said rim and wherein said spoke and said additional spokes are equally spaced from each other circumferentially around said central opening.

5. The chopper plate defined in claim 1 wherein said body is a unitary disc-shaped member having a central opening, and said imperforate area includes a plurality of equally spaced spokes extending radially from said central opening.

6. The chopper plate defined in claim 5 wherein said chopper plate cooperates with a straight cutting edge of a rotatable chopper knife and wherein the spokes are each straight and of greater width and greater length than the width and length of the cutting edge, so that the entire cutting edge will successively engage the surface of each spoke.

7. The chopper plate defined in claim 5 wherein from 3 to 6 of said spokes are disposed in said body.

8. The chopper plate defined in claim 7 wherein the width of each of said spokes is from 1½ to 2 times the diameter of the holes in said perforate areas.

9. The combination, with a meat grinder of the type having a motor driving a central shaft within a barrel conveying meat toward the discharge end of said barrel and chopper knife rotated by the shaft, the knife having a radially extending cutting edge, of a chopper plate comprising:

a unitary circular metal body provided with perforate areas and imperforate areas, the imperforate areas forming equally spaced spokes radiating from the axis of said body, said perforate area having a plurality of circular holes the axes of which are parallel to the axes of the body and wherein said holes are arranged in parallel rows on both sides of said imperforate area.

10. A chopper plate for meat grinder composed of a body having a planar surface for cooperating with the chopper knife of the meat grinder moved along said surface said body having a plurality of perforate areas respectively provided with a plurality of spaced holes, and an imperforate area extending from the central portion of said body to the edge of said body between and separating said perforate areas, the distance between the adjacent holes of the respective perforate areas across said imperforate areas being greater than the distance between adjacent holes within said areas, and wherein said body is disc-shaped and said imperforate area forms a spoke the centerline of which extends at an acute angle to the radius of said body.

11. A chopper plate for meat grinder composed of a body having a planar surface for cooperating with the chopper knife of the meat grinder moved along said surface, said body having a plurality of perforate areas respectively provided with a plurality of spaced holes, and an imperforate area extending from the central portion of said body to the edge of said body between and separating said perforate areas, the distance between the adjacent holes of the respective perforate areas across said imperforate areas being greater than the distance between adjacent holes within said adjacent areas, and wherein said body is disc-shaped and said imperforate area includes a pair of parallel spokes on opposite side of the radius of said body, said spokes being spaced apart by additional perforate areas.

* * * * *